US008544899B2

(12) United States Patent
Hertrich

(10) Patent No.: US 8,544,899 B2
(45) Date of Patent: Oct. 1, 2013

(54) SECURE LATCH ASSEMBLY FOR DRAWERS AND DOORS

(76) Inventor: Gregory P. Hertrich, Longmont, CO (US)

( * ) Notice: Subject to any disclaimer, the term of this patent is extended or adjusted under 35 U.S.C. 154(b) by 331 days.

(21) Appl. No.: 12/987,467

(22) Filed: Jan. 10, 2011

(65) Prior Publication Data

US 2011/0175374 A1 Jul. 21, 2011

Related U.S. Application Data

(60) Provisional application No. 61/295,525, filed on Jan. 15, 2010, provisional application No. 61/325,959, filed on Apr. 20, 2010.

(51) Int. Cl.

| | |
|---|---|
| ***E05C 3/06*** | (2006.01) |
| *E05C 3/12* | (2006.01) |
| *E05C 19/18* | (2006.01) |

(52) U.S. Cl.

USPC ..... 292/195; 292/219; 292/289; 292/297; 292/DIG. 53; 292/DIG. 54; 292/DIG. 60; 292/DIG. 71

(58) Field of Classification Search

USPC ..... 292/195, 194, 1, 288–298; 70/77–86; 312/215, 222; 248/229.15, 229.25, 231.71

See application file for complete search history.

(56) References Cited

U.S. PATENT DOCUMENTS

| | | | | |
|---|---|---|---|---|
| 1,011,637 | A * | 12/1911 | Moebes, Jr. et al. | 292/198 |
| 1,546,255 | A | 7/1925 | Rotzell | |
| 2,532,586 | A | 12/1950 | Wickwire | |
| 3,069,217 | A | 12/1962 | Kors | |
| 3,181,319 | A | 5/1965 | Hudon | |
| 3,437,365 | A | 4/1969 | Zadanoff et al. | |
| 3,834,746 | A | 9/1974 | Hinden | |
| 4,195,867 | A * | 4/1980 | Baillie | 292/174 |
| 4,763,938 | A * | 8/1988 | Schlanger | 292/290 |
| 5,114,194 | A | 5/1992 | Toifl et al. | |
| 5,209,533 | A * | 5/1993 | Menard | 292/288 |
| 6,604,764 | B2 | 8/2003 | Zemzik | |
| 2010/0172079 | A1 * | 7/2010 | Wu et al. | 361/679.21 |

FOREIGN PATENT DOCUMENTS

| | | |
|---|---|---|
| GB | 2103708 A | 2/1983 |

* cited by examiner

*Primary Examiner* — Kristina R Fulton
*Assistant Examiner* — Faria Ahmad
(74) *Attorney, Agent, or Firm* — Roeder & Broder LLP

(57) ABSTRACT

A latch assembly (12) for use with a cabinet (10) that includes a cabinet body (14) and a moving component (16, 30C), comprises a transverse member (346) and a pivoting member (348). The transverse member (346) is selectively coupled to the cabinet body (14). The pivoting member (348) is pivotally secured to the transverse member (346). The pivoting member (348) pivots relative to the transverse member (346) between a first position in which the pivoting member (348) inhibits large scale movement of the moving component (16, 30C) relative to the cabinet body (14), and a second position in which the pivoting member (348) allows for large scale movement of the moving component (16, 30C) relative to the cabinet body (14). Additionally, a portion of the pivoting member (348) can selectively engage a portion of the transverse member (346) to selectively inhibit the pivoting member (348) from pivoting relative to the transverse member (346) and to selectively inhibit large scale movement of the moving component (16, 30C) relative to the cabinet body (14).

22 Claims, 10 Drawing Sheets

SECURE LATCH ASSEMBLY FOR DRAWERS AND DOORS

RELATED APPLICATIONS

This application claims priority on U.S. Provisional Application Ser. No. 61/295,525 filed on Jan. 15, 2010 and entitled "Secure Latching Device for Drawers and Doors to Inhibit Access by Children"; and on U.S. Provisional Application Ser. No. 61/325,959 filed on Apr. 20, 2010 and entitled "A Latch Device for Use on Cabinets and Hutches". As far as is permitted, the contents of U.S. Provisional Application Ser. No. 61/295,525 and U.S. Provisional Application Ser. No. 61/325,959 are incorporated herein by reference.

BACKGROUND

For years, "child-proof" safety latches have been designed and used, primarily in households, to prevent access by young children to drawers and doors of cabinets that may store potentially harmful or dangerous items. Such safety latches are typically designed to be difficult for young children to operate, but may be easily operated by an adult.

Unfortunately, previous safety latches have experienced a variety of drawbacks. For example, in some cases installation and proper adjustment of the safety latches can be time-consuming and difficult especially in the confined cabinet spaces in which such safety latches are typically employed. Additionally, some existing safety latches can cause the cabinet surfaces on which the latch operates to become marred or damaged due to the manner in which the safety latch is secured to the cabinet. Further, some existing safety latches operate by allowing the door or drawer panel to be opened to a limited extent, in order to activate or deactivate the latch mechanism. With such safety latches, this slight opening of the cabinet door or drawer can result in babies and/or young children getting their fingers pinched between the door or drawer and the body of the cabinet. Still further, other existing safety latches may present cost problems, may be fairly complex to operate and/or may be prone to operation failure.

SUMMARY

The present invention is directed to a latch assembly for use with a cabinet that includes a cabinet body and a moving component. The latch assembly comprises a transverse member and a pivoting member. The transverse member is selectively coupled to the cabinet body. The pivoting member is pivotally secured to the transverse member. Additionally, the pivoting member pivots relative to the transverse member between a first position in which the pivoting member inhibits large scale movement of the moving component relative to the cabinet body, and a second position in which the pivoting member allows for large scale movement of the moving component relative to the cabinet body.

In certain, non-exclusive embodiments, the term large scale movement shall mean movement of greater than approximately 3, 2, 1, 0.5, 0.3, 0.2, or 0.1 inches.

In certain embodiments, a portion of the pivoting member selectively engages a portion of the transverse member to selectively inhibit the pivoting member from pivoting relative to the transverse member and to selectively inhibit large scale movement of the moving component relative to the cabinet body.

Additionally, in some embodiments, the pivoting member includes an activator mechanism. In such embodiments, one of the transverse member and the activator mechanism includes a recessed area and the other of the activator mechanism and the transverse member includes a first tab that is selectively positioned within the recessed area. Further, in such embodiments, the pivoting member is inhibited from pivoting relative to the transverse member when the first tab is positioned within the recessed area. Moreover, in such embodiments, the pivoting member is allowed to pivot relative to the transverse member between the first position and the second position when the first tab is removed from the recessed area.

In one embodiment, the activator mechanism further includes a second tab that can be manually manipulated to move the activator mechanism between an engaged position wherein the first tab is positioned within the recessed area, and a disengaged position wherein the first tab is removed from the recessed area. Moreover, the pivoting member can further include a face plate having a plate aperture. In such embodiment, the second tab can extend through the plate aperture.

Further, in some embodiments, the moving component includes a component face. In one such embodiment, the pivoting member pivots relative to the transverse member approximately ninety degrees between the first position, wherein the pivoting member is substantially parallel to the component face, and the second position, wherein the pivoting member is substantially perpendicular to the component face.

Additionally, in certain embodiments, the latch assembly further comprises an attachment assembly that is selectively attached to the cabinet body. In such embodiments, the transverse member is adjustably secured to the attachment assembly. Moreover, in one such embodiment, the attachment assembly includes an attacher body that is selectively attached to the cabinet body, and a support pad that is positioned substantially between the attacher body and the cabinet body. Still further, in one embodiment, the latch assembly can also comprise an adjustment assembly that adjusts the position of the transverse member relative to the attachment assembly.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1A:
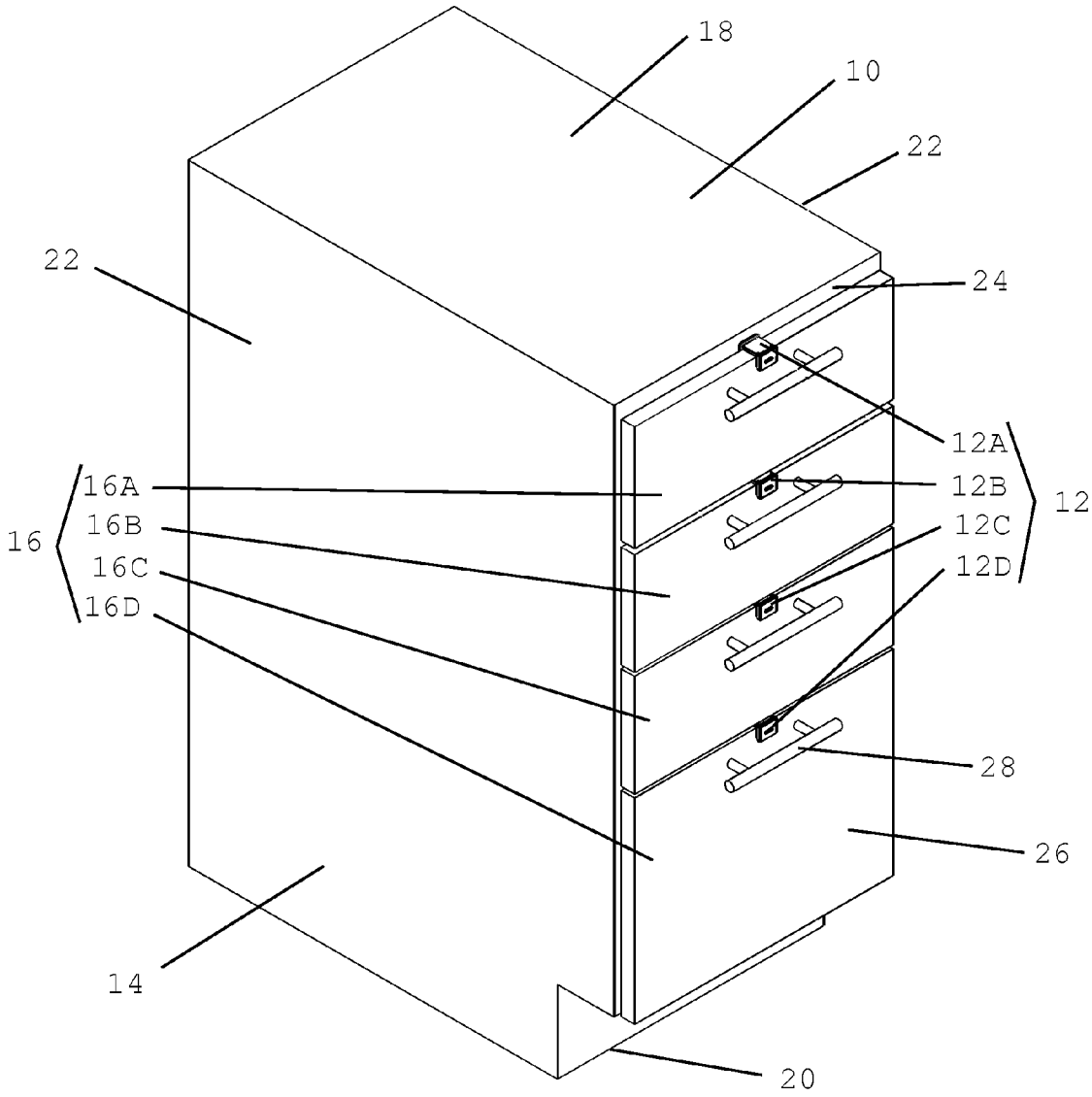
FIG. 1A is a perspective view of a cabinet and a plurality of latch assemblies having features of the present invention, with each of the latch assemblies in a locked position.

FIG. 1A is a perspective view of a cabinet 10 and a plurality of latch assemblies 12 having features of the present invention, with each of the latch assemblies 12 in a locked position. As illustrated, the cabinet 10 includes a cabinet body 14 and one or more drawers 16. More particularly, in this embodiment, the cabinet 10 includes four drawers 16, i.e. a first drawer 16A, a second drawer 16B, a third drawer 16C and a fourth drawer 16D, that are vertically arranged relative to one another. Alternatively, the cabinet 10 can include greater than or less than four drawers 16 and/or the drawers 16 can have a different positional relationship relative to one another. Additionally and/or alternatively, the cabinet 10 can include one or more doors 30C (see, for example, the cabinet 100 as illustrated in FIG. 1C). As utilized herein, the drawers 16 and/or the doors 30C of the cabinet 10 or 100 can be referred to generically as "moving components".

As an overview, the latch assemblies 12 provided herein are uniquely designed so that they can be quickly and easily installed on and/or removed from a drawer 16 or door 30C of the cabinet 10 or 100, and the latch assemblies 12 can be used without causing any unnecessary or unwanted damage to the cabinet 10 or 100. Additionally, the latch assemblies 12 inhibit the drawer 16 or door 30C, i.e. the moving component, of the cabinet 10 or 100 from opening slightly when the latch assemblies 12 are in the locked position, thereby inhibiting any potential pinching of fingers of babies and/or young children. Further, the latch assemblies 12 are visible to the opener of the drawer 16 or door 30C. This provides an indication to the opener of the drawer 16 or door 30C that the latch assembly 12 must be unlatched prior to opening.

As shown in FIG. 1A, the drawers 16 are positioned substantially within the cabinet body 14, i.e. the drawers 16 are closed. Further, as illustrated, a separate latch assembly 12 selectively engages and/or is operative relative to the top of each drawer 16. In particular, a first latch assembly 12A selectively engages and/or is operative relative to the top of the first drawer 16A, a second latch assembly 12B selectively engages and/or is operative relative to the top of the second drawer 16B, a third latch assembly 12C selectively engages and/or is operative relative to the top of the third drawer 16C, and a fourth latch assembly 12D selectively engages and/or is operative relative to the top of the fourth drawer 16D. Alternatively, one or more of the latch assemblies 12A-12D can selectively engage and/or be operative relative to the bottom or one of the sides of the drawers 16A-16D.

It should be noted that any of the drawers 16A-16D can be equally referred to as the first drawer, the second drawer, the third drawer and/or the fourth drawer. Moreover, any of the latch assemblies 12A-12D can be equally referred to as the first latch assembly, the second latch assembly, the third latch assembly and/or the fourth latch assembly.

The cabinet body 14 includes a cabinet top 18, a cabinet bottom 20, a pair of opposed cabinet sides 22 and a cabinet face 24. The cabinet face 24 receives the drawers 16A-16D and effectively provides a frame around at least a portion of each of the drawers 16A-16D. In this embodiment, the cabinet face 24 (i) extends substantially from the cabinet top 18 to near the cabinet bottom 20 on either side of the drawers 16A-16D; and (ii) extends from one cabinet side 22 to the other cabinet side 22 above the first drawer 16A, between adjacent drawers 16A-16D, and below the fourth drawer 16D. With this design, the latch assembly 12A-12D can selectively engage and/or be operative relative to the top, the bottom or possibly either side of the drawers 16A-16D.

Each drawer 16A-16D includes a drawer body (not illustrated), a drawer face 26, and a handle 28. The drawer body provides a storage area for storing items as desired. When the drawer 16A-16D is closed, as illustrated in FIG. 1A, the drawer body is positioned substantially within the cabinet body 14. Conversely, when the drawer 16A-16D is open items can be easily positioned within and/or removed from the drawer 16A-16D. The drawer face 26 faces outwardly away from the drawer body and away from the cabinet body 14. The handle 28 is secured to the drawer face 26 to facilitate the opening and closing of the drawer 16A-16D. Alternatively, each drawer 16A-16D can be designed without a handle 28, and the drawer 16A-16D can be opened utilizing another means.

Figure 1B:
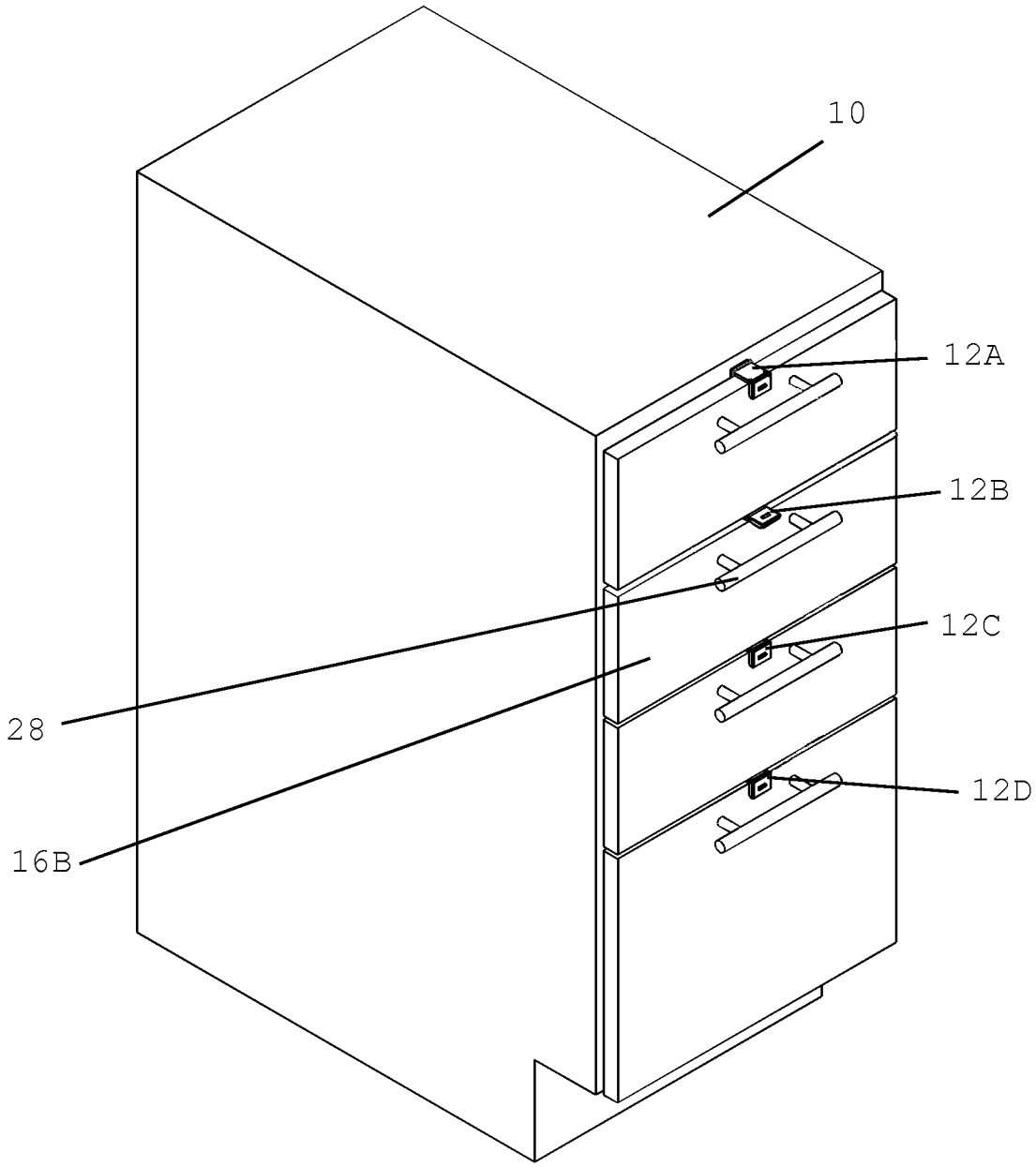
FIG. 1B is a perspective view of the cabinet and the plurality of latch assemblies illustrated in FIG. 1A, with one of the latch assemblies in an unlocked position.
Figure 1C:
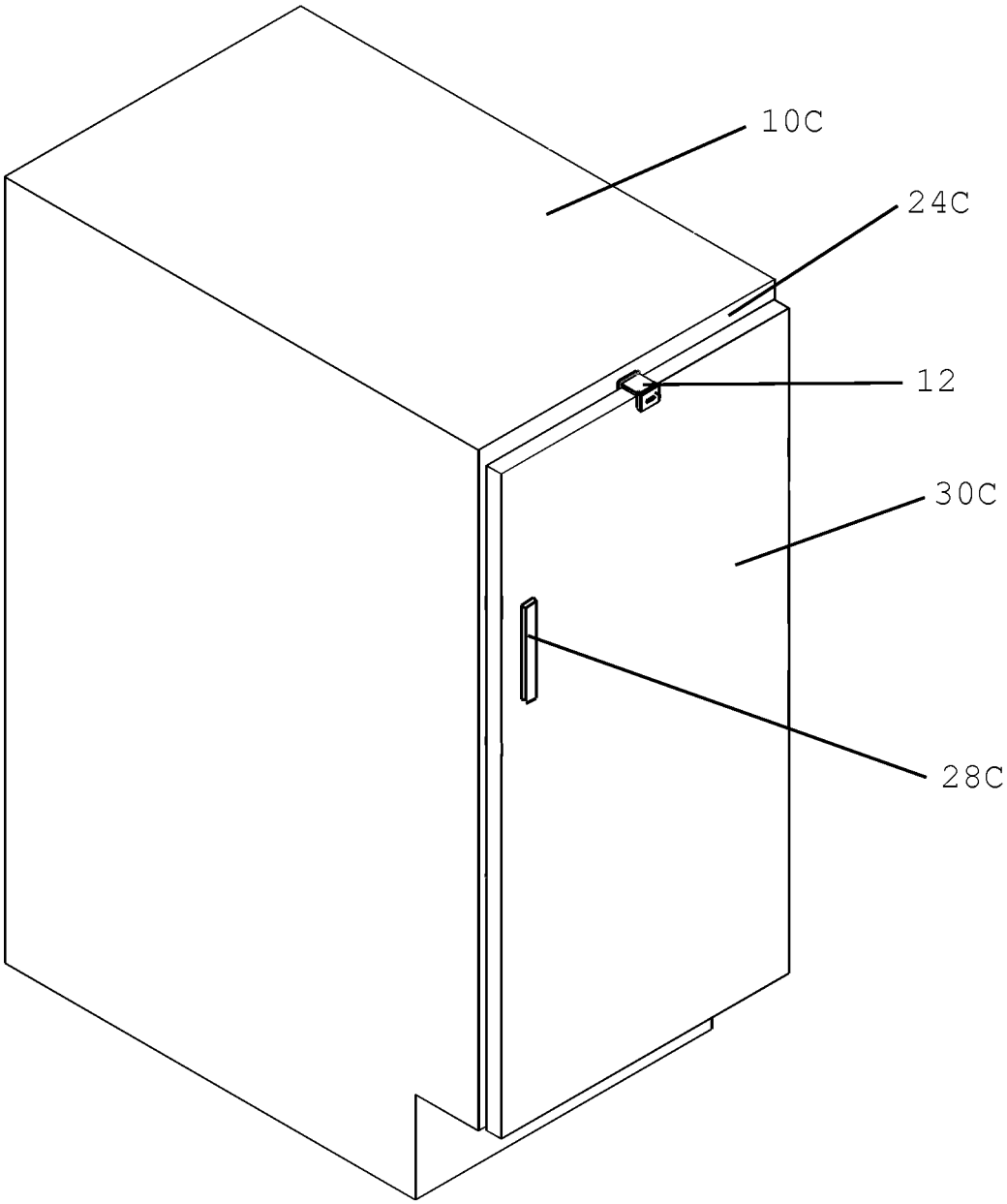
FIG. 1C is a perspective view of another cabinet and the latch assembly illustrated in FIG. 1A.

Additionally, as will be illustrated and described in detail herein, the latch assembly 12 is designed so that the latch assembly 12 can be quickly and easily moved from the locked position (as illustrated in FIG. 1A) to an unlocked position (as illustrated in FIG. 1B). When the latch assembly 12 is in the locked position, the drawer 16 or door 30C is inhibited from being opened, e.g., by pulling on the handle 28. Stated another way, when the latch assembly 12 is in the locked position, the latch assembly 12 inhibits the drawer 16 or door 30C from other than slight movement relative to the cabinet body 14, i.e. the latch assembly 12 inhibits large scale movement and/or substantially complete opening of the drawer 16 or door 30C relative to the cabinet body 14. Conversely, when the latch assembly 12 is in the unlocked position, the drawer 16 or door 30C can easily be opened, e.g., by simply pulling on the handle 28. Stated another way, when the latch assembly 12 is in the unlocked position, the latch assembly 12 allows for large scale movement and/or substantially complete opening of the drawer 16 or door 30C relative to the cabinet body 14.

Further, depending on the particular style and/or design of the cabinet 10, the drawer 16 or door 30C may be able to be moved slightly when the latch assembly 12 is in the locked position, e.g., in a cabinet that includes a bevel around the perimeter. However, even with such cabinets, the allowable movement of the drawer 16 or door 30C would be less than the thickness of the drawer 16 or door 30C, thereby substantially reducing the risk of babies or young children slamming fingers between the drawer 16 or door 30C and the cabinet face 24C.

In different embodiments, the latch assembly 12 can be used for inhibiting children from accessing kitchen and bathroom cabinet drawers and doors. However, the latch assembly 12 may also be used in dressers, marine cabinets, and motor home cabinets. For example, in marine cabinets and motor home applications, it is desirable to keep cabinet drawers and doors from opening while underway.

FIG. 1B is perspective view of the cabinet 10 and the plurality of latch assemblies 12A-12D illustrated in FIG. 1A, with one of the latch assemblies 12A-12D, i.e. the second latch assembly 12B that engages the second drawer 16B, in the unlocked position. With the second latch assembly 12B in the unlocked position, the second drawer 16B can easily be opened merely by pulling on the handle 28.

FIG. 1C is a perspective view of another cabinet 100 and a latch assembly 12 as illustrated in FIG. 1A. In particular, FIG. 1C illustrates the cabinet 100 including a door 30C that is secured to the cabinet face 24C of the cabinet 10C. Alternatively, the cabinet 10C can include more than one door and/or the cabinet 10C can also include one or more drawers.

As illustrated, the latch assembly 12 selectively engages the top of the door 30C. Alternatively, the latch assembly 12 can selectively engage the bottom of the door 30C or the latch assembly 12 can possibly selectively engage the side of the door 30C away from the hinges (not illustrated), i.e. toward the handle 28C. Further, as illustrated, the latch assembly 12 is in the locked position, thereby inhibiting the door 30C from being opened e.g., by simply pulling on the handle 28C. In certain alternative embodiments, the door 30C can be designed without a handle 28C, and the door 30C can be opened utilizing another means.

Figure 2A:
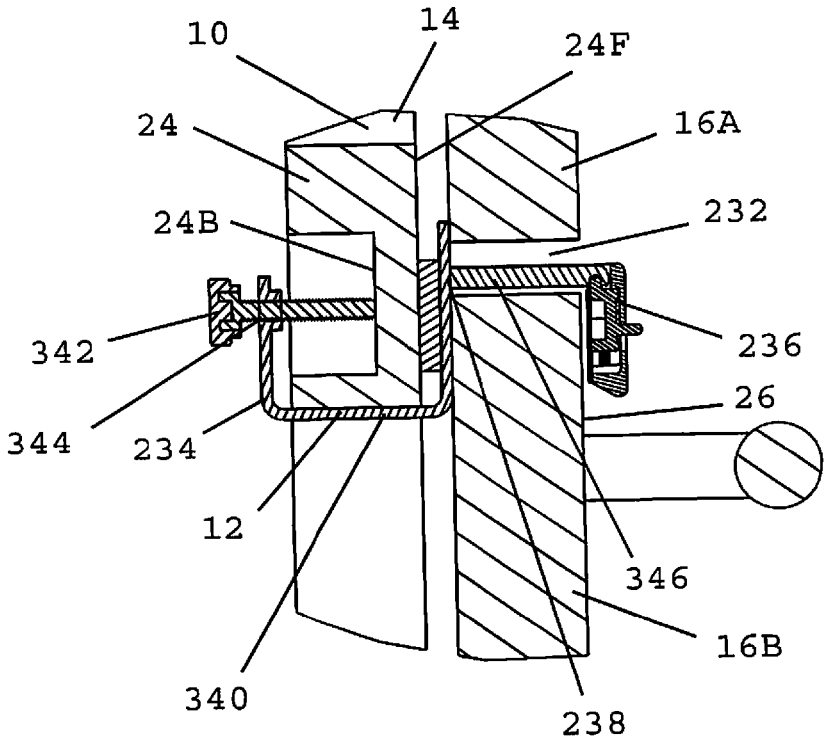
FIG. 2A is a cross-sectional side view of a portion of the cabinet and an embodiment of the latch assembly illustrated in FIG. 1A, with the latch assembly in the locked position.

FIG. 2A is a cross-sectional side view of a portion of the cabinet 10 and an embodiment of the latch assembly 12 illustrated in FIG. 1A, with the latch assembly 12 in the locked position. In particular, FIG. 2A illustrates a portion of the first drawer 16A, a portion of the second drawer 16B, a portion of the cabinet body 14, and the latch assembly 12. As shown, the latch assembly 12 selectively engages and/or is operative relative to the second drawer 16B. Further, the latch assembly 12 is in the locked position so that the second drawer 16B can not readily be opened without otherwise moving the latch assembly 12 to the unlocked position. It should be noted that although FIG. 2A illustrates the latch assembly 12 selectively engaging and/or being operative relative to a drawer, i.e. to the second drawer 16B, the latch assembly 12 can equally selectively engage and/or be operative relative to a door 30C (illustrated in FIG. 1C) of the cabinet 100 (illustrated in FIG. 1C).

As illustrated in FIG. 2A, the cabinet body 14 includes the cabinet face 24, with at least a portion of the cabinet face 24 positioned substantially between and/or adjacent to the drawers 16A, 16B so as to allow a certain amount of spacing between adjacent drawers 16A, 16B. The cabinet face 24 faces generally outward away from the rest of the cabinet body 14 in the same direction as the drawers 16A, 16B. For example, in one embodiment, the cabinet 10 can include a gap 232 of approximately three-sixteenths (3/16) inches between adjacent drawers 16A, 16B. Alternatively, the gap 232 between adjacent drawers 16A, 16B can be greater than or less than three-sixteenths inches.

The design of the latch assembly 12 can be varied to suit the specific requirements of the cabinet 10. In the embodiment illustrated in FIG. 2A, the latch assembly 12 includes an attachment assembly 234, a locking assembly 236, and an adjustment assembly 238. Alternatively, in certain embodiments, the latch assembly 12 can be designed without an attachment assembly 234 and/or without an adjustment assembly 238.

The attachment assembly 234 is selectively attached to the cabinet 10, e.g., to the cabinet body 14, to selectively couple the locking assembly 236 to the cabinet 10, e.g., to the cabinet body 14. Additionally, the attachment assembly 234, as described herein, selectively couples the locking assembly 236 to the cabinet body 14 without damaging the visible part of the cabinet body 14.

The design of the attachment assembly 234 can be varied to suit the specific requirements of the latch assembly 12 and/or the cabinet 10. In the embodiment illustrated in FIG. 2A, the attachment assembly 234 selectively provides pressure and/or contact on both the front 24F and the back 24B of the cabinet face 24 to selectively couple the locking assembly 236 to the cabinet face 24. Alternatively, the attachment assembly 234 can have a different design. Still alternatively, in certain embodiments, the latch assembly 12 can be designed without an attachment assembly 234. For example, in one non-exclusive alternative embodiment, the locking assembly 236 can be directly secured to or otherwise selectively coupled to the cabinet 10, e.g., to the cabinet body 14.

As shown in FIG. 2A, the portion of the cabinet face 24 positioned substantially between and/or adjacent to the drawers 16A, 16B can have a substantially C-shaped cross-sectional profile. Alternatively, the portion of the cabinet face 24 positioned substantially between and/or adjacent to the drawers 16A, 16B can have a different cross-sectional profile, such as a square shape, a rectangle shape, or some other shape.

Figure 2B:
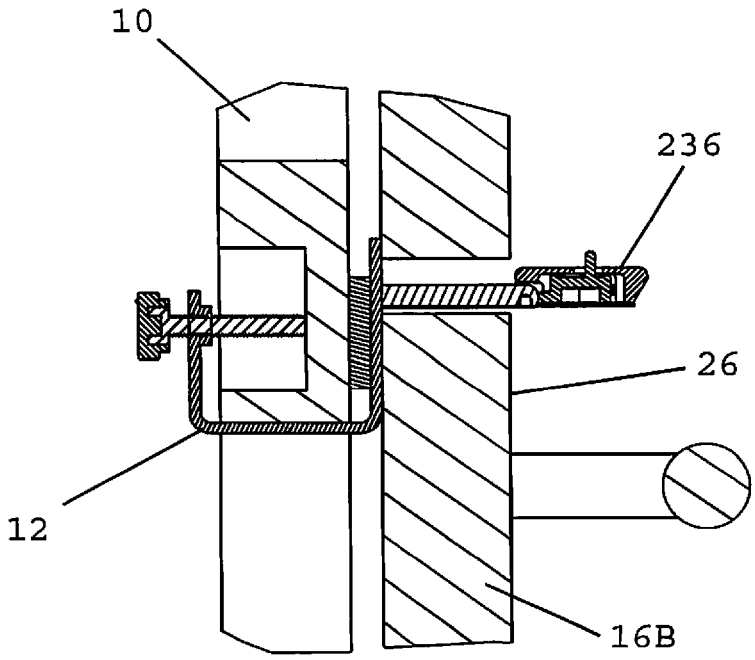
FIG. 2B is a cross-sectional side view of a portion of the cabinet and the latch assembly illustrated in FIG. 2A, with the latch assembly in the unlocked position.

In this embodiment, the locking assembly 236 is adjustably secured to the attachment assembly 234. The locking assembly 236 provides the operative portion of the latch assembly 12 so that the latch assembly 12 can be quickly and easily moved between the locked position, as illustrated in FIG. 2A, and the unlocked position, as illustrated in FIG. 2B. When in the locked position, a portion of the locking assembly 236 engages and/or is positioned in front of the second drawer 16B, i.e. engages and/or is positioned adjacent to the drawer face 26, so that the second drawer 16B is inhibited from being opened. Further, with this design, the locking assembly 236 is easily visible to the user of the cabinet 10. Moreover, the positioning of the portion of the locking assembly 236 so that it engages and/or is positioned adjacent to the drawer face 26 or door face when in the locked position, limits the movement of the drawer 16 or door 30C so as to inhibit the pinching of fingers between the drawer 16 or door 30C and the cabinet face 24.

The adjustment assembly 238 adjusts the position of the locking assembly 236 relative to the attachment assembly 234 and, thus, adjusts the position of the locking assembly 236 relative to the drawers 16A, 16B and the cabinet body 14. Additionally, the adjustment assembly 238 adjusts the position of the locking assembly 236 to enable the latch assembly 12 to be used on drawers 16 or doors 30C of different heights relative to the cabinet face 24. More particularly, the adjustment assembly 238 adjusts the position of the locking assembly 236 so that the locking assembly 236 can more effectively maintain the second drawer 16B in a closed position. As shown in FIG. 2A, the adjustment assembly 238 enables a portion of the locking assembly 236 to extend across and be positioned very close to the top of the second drawer 16B. In some embodiments, when the latch assembly 12 selectively engages and/or is operative relative to the top of the drawer 16B, the closer the locking assembly 236 is positioned to the top of the drawer 16B, the higher the force required to cause the latch assembly 12 to malfunction.

The adjustment assembly 238 enables the latch assembly 12 to be used with a wider range of cabinet styles available on the market, and allows the possibility of mounting the latch assembly 12 on either the top, bottom or side of the particular cabinet drawer 16, or the top, bottom or side of a cabinet door 30C.

FIG. 2B is a cross-sectional side view of a portion of the cabinet 10 and the latch assembly 12 illustrated in FIG. 2A, with the latch assembly 12 in the unlocked position. As illustrated, when the latch assembly 12 is in the unlocked position, no portion of the locking assembly 236 is positioned in front of the second drawer 16B, i.e. no portion of the locking assembly 236 engages and/or is positioned adjacent to the drawer face 26, and the second drawer 16B can be quickly and easily opened and closed without otherwise moving the latch assembly 12. Stated another way, when the latch assembly 12 is in the unlocked position, the locking assembly 236 does not inhibit the second drawer 16B from being opened or closed as desired. It should be noted that although FIG. 2B illustrates the latch assembly 12 selectively engaging and/or being operative relative to a drawer, i.e. to the second drawer 16B, the latch assembly 12 can equally selectively engage and/or be operative relative to a door 30C (illustrated in FIG. 1C) of the cabinet 100 (illustrated in FIG. 1C).

Figure 3A:
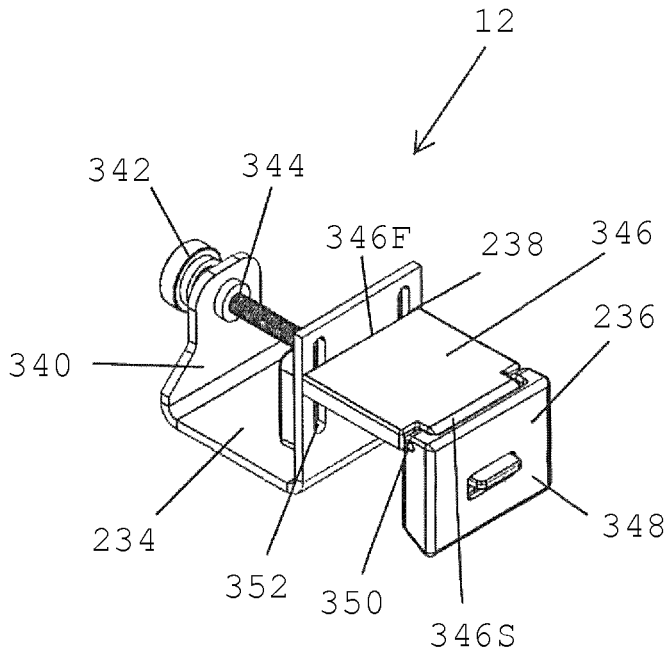
FIG. 3A is a perspective view of the latch assembly illustrated in FIG. 2A, with the latch assembly in the locked position.

FIG. 3A is a perspective view of the latch assembly 12 illustrated in FIG. 2A, with the latch assembly 12 in the locked position. More particularly, FIG. 3A illustrates certain features of and the interrelationship between the attachment assembly 234, the locking assembly 236 and the adjuster assembly 238.

As provided above, the attachment assembly 234 selectively couples the locking assembly 236 to the cabinet body 14 (illustrated, for example, in FIG. 2A). The design of the attachment assembly 234 can be varied to suit the specific design requirements of the latch assembly 12 and/or the cabinet 10 (illustrated in FIG. 1A). In this embodiment, the attachment assembly 234 includes an attacher body 340, and an attacher adjuster 342.

As illustrated in the embodiment shown in FIG. 3A, the attacher body 340 can be substantially U-shaped. Additionally, the attacher body 340 can be made from sheet metal and can be very inexpensive to fabricate in large quantities. Alternatively, the attacher body 340 can have a different shape and/or the attacher body 340 can be made of other suitable materials.

Referring back to FIG. 2A, in one embodiment, the attacher body 340 can be a clamp body that is adapted to be positioned about the portion of the cabinet body 14, i.e. the portion of the cabinet face 24, that is positioned substantially between and/or adjacent to the first drawer 16A and the second drawer 16B. Additionally, as shown in FIG. 2A, with the latch assembly 12 selectively engaging and/or operative relative to the top of the second drawer 16B to selectively maintain the second drawer 16B in the closed position, the attacher body 340 extends underneath the portion of the cabinet face 24 that is positioned substantially between and/or adjacent to the first drawer 16A and the second drawer 16B.

In different embodiments, different size attacher bodies 340, e.g., clamp bodies, may be required depending on the size of the cabinet 10 or drawers 16A, 16B or door 30C (illustrated in FIG. 1C).

Further, the attacher adjuster 342, e.g., a screw, is used to maintain the attacher body 340 positioned substantially adjacent to the cabinet body 14, the first drawer 16A and/or the second drawer 16B. More particularly, when the latch assembly 12 is coupled to the cabinet 10, a portion of the attacher body 340 is positioned in contact with and/or substantially adjacent to the front 24F of the cabinet face 24 and a portion of the attacher adjuster 342 is in contact with and/or substantially adjacent to the back 24B of the cabinet face 24.

Again referring to FIG. 3A, the attacher body 340 can include an attacher aperture 344 and the attacher adjuster 342 can extend through the attacher aperture 344. In one embodiment, the attacher adjuster 342 is externally threaded and the attacher aperture 344 is internally threaded such that the attacher adjuster 342 threadedly engages the attacher aperture 344. Alternatively, the attacher body 340 and the attacher adjuster 342 can interact with and/or engage one another in a different manner.

As shown in FIG. 2A, the attacher adjuster 342 can extend through, e.g., be threaded through, the attacher aperture 344 so that the attacher adjuster 342 can be tightened firmly against the back 24B of the cabinet face 24 to maintain the position of the attacher body 340 relative to the cabinet body 14, the first drawer 16A and the second drawer 16B.

Again referring to FIG. 3A, the locking assembly 236 is adjustably secured to the attachment assembly 234 so as to enable the latch assembly 12 to be quickly and easily moved between the locked position and the unlocked position. The design of the locking assembly 236 can be varied to suit the specific design requirements of the latch assembly 12 and/or the cabinet 10. As shown in the embodiment illustrated in FIG. 3A, the locking assembly 236 includes a transverse member 346 and a pivoting member 348.

In this embodiment, the transverse member 346 is adjustably secured to and cantilevers substantially perpendicularly away from the attacher body 340. With this design, the transverse member 346 can be selectively coupled to the cabinet 10. Further, when installed, the transverse member 346 is designed to extend substantially along an edge, i.e. along the top, the bottom or possibly a side, of the drawer 16 or door 30C of the cabinet 10. Moreover, in some embodiments, the closer the locking assembly 236 is positioned to the edge of the drawer 16 or door 30C, the higher the force required to cause the latch assembly 12 to malfunction.

As illustrated, the transverse member 346 has a substantially square, flat plate-like design and includes a first end 346F, and an opposed second end 346S. Alternatively, the transverse member 346 can have a different shape and/or a different design.

As shown, the first end 346F of the transverse member 346 is adjustably secured to the attacher body 340.

Additionally, in this embodiment, the pivoting member 348 is pivotally secured to the transverse member 346 and/or the pivoting member 348 is pivotally coupled to the attachment assembly 234. More particularly, in this embodiment, the pivoting member 348 is pivotally secured to the second end 346S of the transverse member 346. Alternatively, the pivoting member 348 can be pivotally secured to a different portion of the transverse member 346.

Figure 4A:
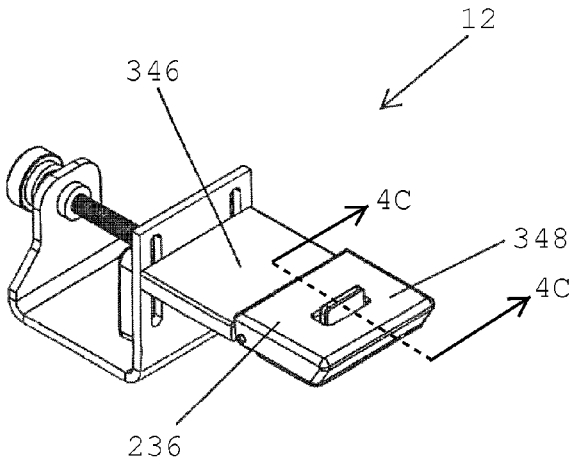
FIG. 4A is a perspective view of the latch assembly illustrated in FIG. 2A, with the latch assembly in the unlocked position.

Further, the pivoting member 348 is adapted to pivot about a pivot pin 350 relative to the transverse member 346 between a first position (as illustrated in FIG. 3A), with the latch assembly 12 in the locked position, and a second position (as illustrated in FIG. 4A), with the latch assembly 12 in the unlocked position.

As illustrated and described herein, a portion of the pivoting member 348 selectively engages a portion of the transverse member 346 to selectively inhibit the pivoting member 348 from pivoting relative to the transverse member 346. For example, when the pivoting member 348 is in the first position, a portion of the pivoting member 348 engages a portion of the transverse member 346, and the pivoting member 348 is inhibited from pivoting relative to the transverse member 346. Moreover, when the pivoting member 348 is in the first position, the pivoting member 348 inhibits the drawer 16 or door 30C from other than slight movement relative to the cabinet body 14, i.e. the pivoting member 348 inhibits large scale movement of the drawer 16 or door 30C relative to the cabinet body 14.

Conversely, when the pivoting member 348 is in the second position, the pivoting member 348 is free to pivot relative to the transverse member 346. Moreover, when the pivoting member 348 is in the second position, the pivoting member 348 allows for large scale movement of the drawer 16 or door 30C relative to the cabinet body 14.

It should be noted that the use of the terms "first position" and "second position" is merely for ease of description, and either position can be equally referred to as the first position and/or the second position.

As provided above, the adjustment assembly 238 adjusts the position of the locking assembly 236, e.g., the transverse member 346, relative to the attachment assembly 234. The design of the adjustment assembly 238 can be varied to suit the specific design requirements of the latch assembly 12 and/or the cabinet 10. In this embodiment, the adjuster assembly 238 includes one or more adjuster slots 352, one or more adjuster apertures (not illustrated), and one or more adjuster attachers 354 (illustrated in FIG. 3B). More particularly, as illustrated in FIG. 3A, the adjustment assembly 238 includes a pair of adjuster slots 352, a pair of adjuster apertures and a pair of adjuster attachers 354. Alternatively, the adjuster assembly 238 can be designed to include greater than two or less than two adjuster slots 352, adjuster apertures and adjuster attachers 354.

The adjuster slots 352 are substantially vertically oriented within the attacher body 340, i.e. when the latch assembly 12 selectively engages the top or bottom of a drawer 16 (illustrated in FIG. 1A) or door 30C (illustrated in FIG. 1C). As illustrated, the adjuster slots 352 can extend approximately two-thirds of the height of the attacher body 340. Alternatively, the adjuster slots 352 can be designed to extend greater than or less than two-thirds the height of the attacher body 340. The adjuster slots 352 enable the transverse member 346 to be positioned at different positions relative to the attacher body 340 so as to fit drawers 16 or doors 30C of different sizes and/or to accommodate different sizes of the cabinet body 14. For example, as shown in FIG. 2A, the transverse member 346 can be secured to the attacher body 340 such that the transverse member 346 is positioned as near to the top of the second drawer 16B as is reasonably possible so that the locking assembly 236 can more effectively maintain the second drawer 16B in the closed position.

In one embodiment, the adjuster slots 352 can enable the latch assembly 12 to exhibit approximately one-half inch of adjustability for the locking assembly 236 relative to the attachment assembly 234. Alternatively, the adjuster slots 352 can be designed to allow the latch assembly to exhibit greater than or less than one-half inch of adjustability for the locking assembly 236 relative to the attachment assembly 234.

The adjuster apertures are adapted to receive and retain the one or more adjuster attachers 354. In one embodiment, the adjuster apertures are positioned at or near the first end 346F of the transverse member 346. Alternatively, the adjuster apertures can be positioned in a different portion of the transverse member 346.

Figure 3B:
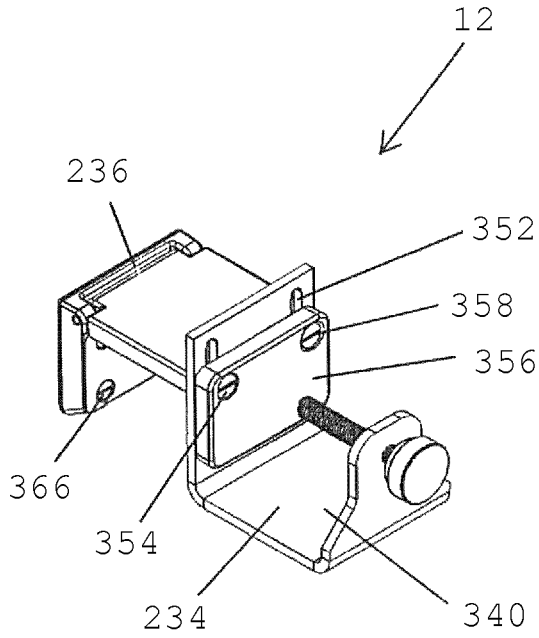
FIG. 3B is another perspective view of the latch assembly illustrated in FIG. 3A.

FIG. 3B is another perspective view of the latch assembly 12 illustrated in FIG. 3A. As illustrated in FIG. 3B, the attachment assembly 234 can further include a support pad 356 that is positioned substantially between the attacher body 340 and the cabinet body 14 (illustrated in FIG. 2A), i.e. between the attacher body 340 and the cabinet face 24 (illustrated in FIG. 2A). The support pad 356 can be made of a soft material so as to inhibit any potential marring or damaging of the cabinet body 14 that may be caused by contact between the attacher body 340 and the cabinet body 14. Alternatively, the attachment assembly 234 can be designed without the support pad 356 and/or the support pad 356 can have a different design.

Additionally, as illustrated in FIG. 3B, the support pad 356 can include a pair of pad apertures 358, and the adjuster attachers 354, e.g., screws, can extend through the pad apertures 358 and the adjuster slots 352, and into the adjuster apertures. With this design, the support pad 356 can be effectively secured to the attacher body 340 and the locking assembly 236 can be adjustably secured to the attachment assembly 234. Further, as it may be desired to adjustably secure the locking assembly 236 to the attachment assembly 234 anywhere along the length of the adjuster slots 352, the support pad 356 can easily be rotated 180 degrees relative to the attacher body 340 so that it can be used regardless of the specific positioning of the locking assembly 236 relative to the attachment assembly 234.

With the specific design as described in detail herein, no holes need to be drilled in the cabinet face 24, the drawer 16 or the door 30C, and no adhesives need to be used for purposes of installation or use of the latch assembly 12. Further, the attachment assembly 234 installs on a drawer 16 or door 30C of the cabinet 10 quickly and easily. Moreover, as noted, the attachment assembly 234 utilizes the soft support pad 356 to protect the cabinet face 24 finish from scratches or dents. Additionally, with this design, the latch assembly 12 can be quickly and easily mounted on and/or removed from a cabinet drawer 16 or door 30C to enable easy use in multiple households as desired.

Figure 3C:
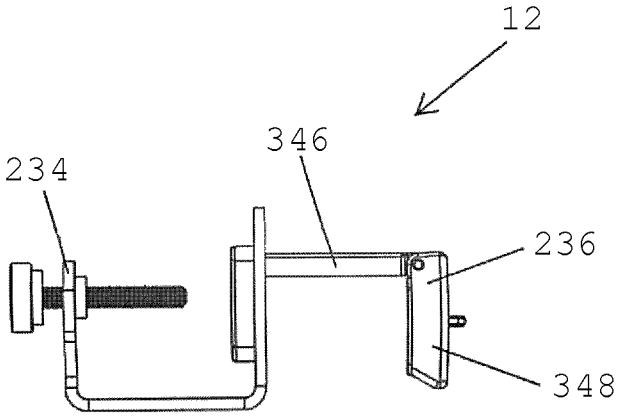
FIG. 3C is a side view of the latch assembly illustrated in FIG. 3A.

FIG. 3C is a side view of the latch assembly 12 illustrated in FIG. 3A. More particularly, FIG. 3C illustrates the relative orientation and positioning of the attachment assembly 234 and the locking assembly 236 when the latch assembly 12 is in the locked position. Moreover, FIG. 3C illustrates the pivoting member 348 in the first position, with the pivoting member 348 positioned substantially perpendicular to the transverse member 346.

Figure 3D:
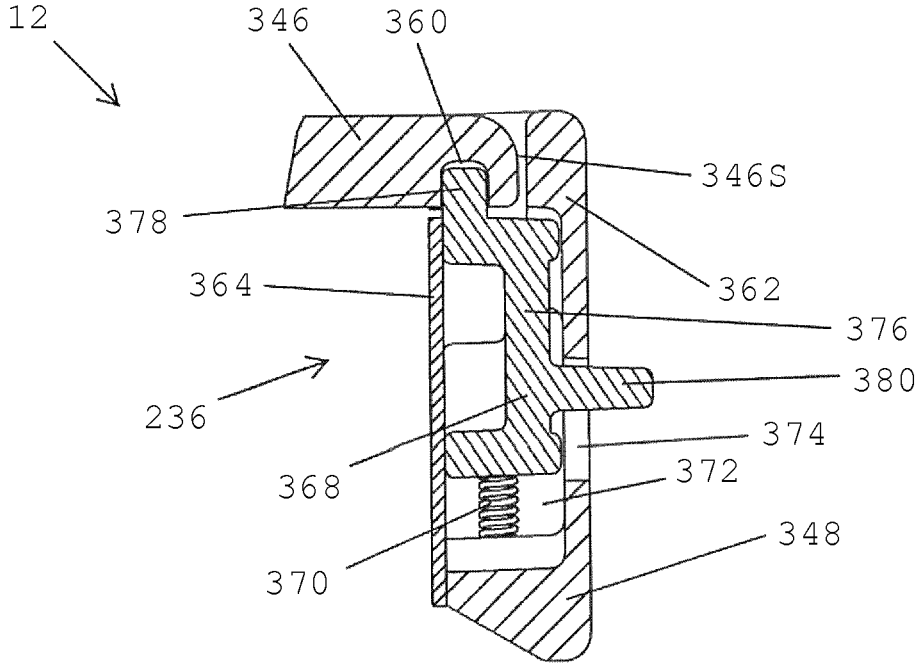
FIG. 3D is a cross-sectional side view of a portion of the latch assembly illustrated in FIG. 3A.

FIG. 3D is a cross-sectional side view of a portion of the latch assembly 12 illustrated in FIG. 3A. In particular, FIG. 3D is a cross-sectional view of a portion of the locking assembly 236, with the pivoting member 348 in the first position, i.e. the latch assembly 12 is in the locked position. As provided above, when the pivoting member 348 is in the first position, a portion of the pivoting member 348 engages a portion of the transverse member 346, and the pivoting member 348 is inhibited from pivoting relative to the transverse member 346.

In this embodiment, the transverse member 346 of the locking assembly 236 includes a recessed area 360 positioned near the second end 346S. The recessed area 360 is adapted to selectively receive and retain a portion of the pivoting member 348 of the locking assembly 236. Alternatively, the pivoting member 348 can include a recessed area that is adapted to selectively receive and retain a portion of the transverse member 346.

Additionally, as illustrated in this embodiment, the pivoting member 348 includes a face plate 362, a back plate 364, one or more plate attachers 366 (illustrated in FIG. 3B), an activator mechanism 368, and one or more resilient members 370.

As shown in FIG. 3D, the face plate 362 can have a somewhat J-shaped cross-section. Additionally, the back plate 364 is a substantially flat plate that is secured to the face plate 362 with the one or more plate attachers 366. The face plate 362 and the back plate 364 cooperate to define a member cavity 372, with the activator mechanism 368 and the one or more resilient members 370 being positioned substantially within the member cavity 372. Further, the face plate 362 and the back plate 364 cooperate to guide the movement of the activator mechanism 368 within the member cavity 372.

Additionally, the face plate 362 further includes a plate aperture 374, with a portion of the activator mechanism 368 being adapted to extend through the plate aperture 374.

As illustrated in this embodiment, the activator mechanism 368 includes a mechanism body 376, an end tab 378 and a front tab 380. As illustrated, the mechanism body 376 is somewhat C-shaped and is positioned within the member cavity 372. Alternatively, the mechanism body 376 can have a different design.

The end tab 378 extends away from an end of the mechanism body 376, and is selectively positioned within the recessed area 360 that is positioned near the second end 346S of the transverse member 346. More particularly, as shown in FIG. 3D, when the pivoting member 348 is in the first position, i.e. when the latch assembly 12 is in the locked position, the end tab 378 is positioned substantially within the recessed area 360.

Further, the front tab 380 cantilevers away from the rest of the mechanism body 376. Moreover, as shown in FIG. 3D, at least a portion of the front tab 380 is adapted to extend through the plate aperture 374. The plate aperture 374 is sized so as to allow for limited translational movement of the front tab 380, and thus the activator mechanism 368, relative to the face plate 362. In particular, the activator mechanism 368, via the manual translational movement of the front tab 380, is selectively movable between an engaged position and a disengaged position. When in the engaged position, the end tab 378 is positioned substantially within the recessed area 360, as shown in FIG. 3D, the latch assembly 12 is in the locked position, and the pivoting member 348 is inhibited from pivoting relative to the transverse member 346. When in the disengaged position, the end tab 378 has been removed from the recessed area 360 and the pivoting member 348 can be pivoted, e.g., by approximately ninety degrees, relative to the transverse member 346, as shown in FIG. 3D, so that the latch assembly 12 is in the unlocked position.

As provided above, the one or more resilient members 370 are positioned substantially within the member cavity 372. Additionally, as shown, the one or more resilient members 370 can be positioned between the activator mechanism 368 and the face plate 362 away from the transverse member 346. In one embodiment, the one or more resilient members 370 are biased so as to maintain the end tab 378 positioned within the recessed area 360 of the transverse member 346 absent intentional movement of the front tab 380 of the activator mechanism 368 relative to the face plate 362 within the plate aperture 374. With this design, the latch assembly 12 will be inhibited from inadvertently or unintentionally moving from the locked position to the unlocked position.

Further, in one embodiment, the pivoting member 348 can include two resilient members 370 (only one is illustrated in FIG. 3D). Alternatively, the pivoting member 348 can include more than two or less than two resilient members 370.

When the pivoting member 348 is in the first position and the latch assembly 12 is in the locked position, the face plate 362 of the pivoting member 348 is positioned in front of a portion of one of the drawers 16 or the door 30C, e.g., is substantially parallel to the drawer face 26 (illustrated in FIG. 2A), so that the drawer 16 or door 30C is inhibited from being opened.

In one embodiment, at least a portion of the pivoting member 348 can be made of a softer material to protect the finish of the drawer 16 or door 30C of the cabinet 10 from scratches or dents.

FIG. 4A is a perspective view of the latch assembly 12 illustrated in FIG. 2A, with the latch assembly 12 in the unlocked position. More particularly, FIG. 4A illustrates the pivoting member 348 of the locking assembly 236 in the second position relative to the transverse member 346.

Figure 4B:
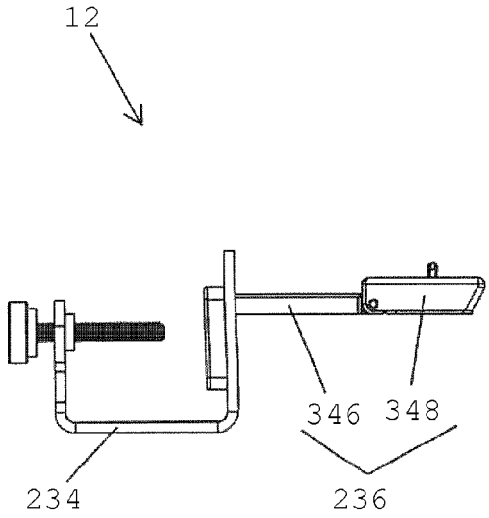
FIG. 4B is a side view of the latch assembly illustrated in FIG. 4A.

FIG. 4B is a side view of the latch assembly 12 illustrated in FIG. 4A. More particularly, FIG. 4B illustrates the relative orientation and positioning of the attachment assembly 234 and the locking assembly 236 when the latch assembly 12 is in the unlocked position. Moreover, FIG. 4B illustrates the pivoting member 348 in the second position, with the pivoting member 348 essentially extending from and/or being substantially parallel to the transverse member 346.

Figure 4C:
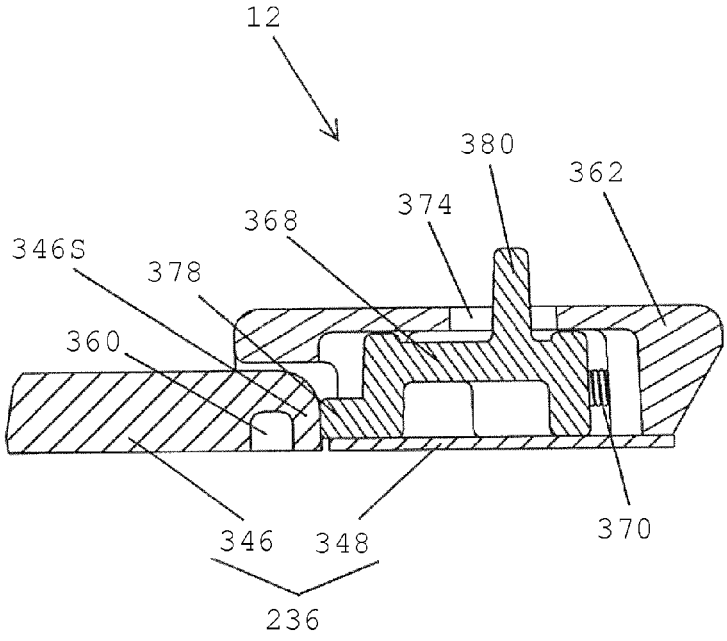
FIG. 4C is a cross-sectional side view of a portion of the latch assembly taken on line 4C-4C in FIG. 4A.

FIG. 4C is a cross-sectional side view of a portion of the latch assembly taken on line 4C-4C in FIG. 4A. In particular, FIG. 4C is a cross-sectional view of a portion of the locking assembly 236, with the pivoting member 348 in the second position, i.e. the latch assembly 12 is in the unlocked position. As provided above, when the pivoting member 348 is in the second position, the pivoting member 348 is free to pivot relative to the transverse member 346.

In moving the pivoting member 348 from the first position, as illustrated in FIG. 3D), to the second position, as illustrated in FIG. 4C, the activator mechanism 368 is initially moved translationally relative to the face plate 362 within the plate aperture 374. Stated another way, the activator mechanism 368 is first moved from the engaged position, with the end tab 378 positioned substantially within the recessed area 360, to the disengaged position, with the end tab 378 having been removed from and/or being no longer positioned substantially within the recessed area 360. With the activator mechanism 368 in the disengaged positioned, the pivoting member 348 can then be pivoted relative to the transverse member 346 to the second position, e.g., approximately ninety degrees, so that the latch assembly 12 is moved to and/or positioned in the unlocked position.

Further, when the pivoting member 348 is in the second position and the latch assembly 12 is in the unlocked configuration, the face plate 362 of the pivoting member 348 is positioned co-extensive with and/or parallel to the transverse member 346, and the face plate 362 is substantially perpendicular to the drawer face 26 (illustrated in FIG. 2B). Moreover, when the pivoting member 348 is in the second position, the end tab 378 is easily and readily maintained outside the recessed area 360 of the transverse member 346. Additionally, the resilient members 370 are generally compressed when the pivoting member 348 is in the second position, which can thereby cause the end tab 378 of the activator mechanism 368 to be forced against the second end 346S of the transverse member 346 so as to maintain the pivoting member 348 in the second position.

When returning the pivoting member 348 to the first position, the pivoting member is rotated relative to the transverse member 346. During this process, at some point before the pivoting member 348 has been rotated fully back so that the pivoting member 348 is again substantially perpendicular to the transverse member 346, the resilient members 370 will cause the pivoting member 348 to continue rotating so that the activator mechanism 368 is again in the engaged position, the pivoting member 348 is again in the first position, and the latch assembly 12 is again in the locked position. Alternatively, the locking assembly 236 can be designed without the resilient members 370, and the front tab 380 can thus require manual manipulation to return the activator mechanism 368 to the engaged position where the end tab 378 is again positioned within the recessed area 360 of the transverse member 346.

Figure 5:
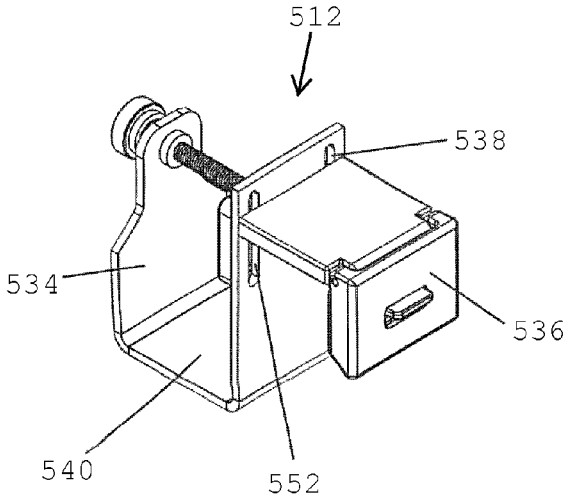
FIG. 5 is a perspective view of another embodiment of the latch assembly.

FIG. 5 is a perspective view of another embodiment of a latch assembly 512 having features of the present invention. As illustrated in FIG. 5, the latch assembly 512 is substantially similar to the latch assembly 12 illustrated and described above with regard to FIG. 2A. However, in this embodiment, the attacher body 540 of the attachment assembly 534 includes sides that are somewhat longer or taller than in the previous embodiment, thereby enabling the latch assembly 512 to be utilized with cabinets of different sizes and/or shapes. Further, the adjustment assembly 538 includes adjuster slots 552 that enable an additional five-eighths inches of adjustability for the locking assembly 536 relative to the attachment assembly 534. Moreover, the latch assembly 512 illustrated in FIG. 5, in combination with the latch assembly illustrated in FIG. 2A, can enable approximately 1% inches of total adjustability. Alternatively, the adjuster slots 552 can be designed to enable greater than an additional five-eighths or less than an additional five-eighths inches of adjustability, and/or the combination of latch assemblies 12, 512 can enable greater than or less than approximately 1% inches of total adjustability.

Figure 6A:
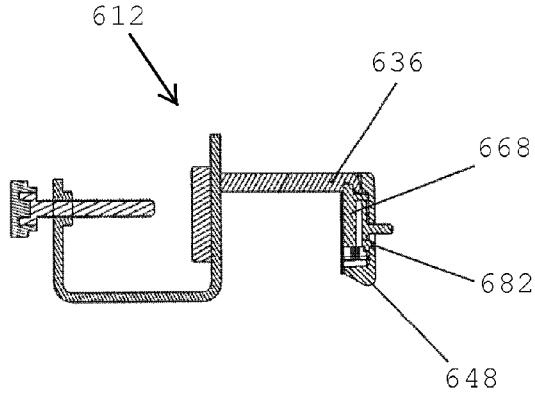
FIG. 6A is a cross-sectional side view of still another embodiment of the latch assembly.

FIG. 6A is a cross-sectional side view of still another embodiment of a latch assembly 612 having features of the present invention. As illustrated in FIG. 6A, the latch assembly 612 is substantially similar to the latch assembly 12 illustrated and described above with regard to FIG. 2A. However, in this embodiment, the pivoting member 648 of the locking assembly 636, i.e. the activator mechanism 668, further includes a second front tab 682 and a second resilient member (not illustrated). The second front tab 682 and the second resilient member cooperate to provide an additional mechanism to inhibit the activator mechanism 668 from inadvertently and/or unintentionally being moved from the engaged position to the disengaged position. Alternatively, the activator mechanism 668 can be designed without the second resilient member.

Figure 6B:
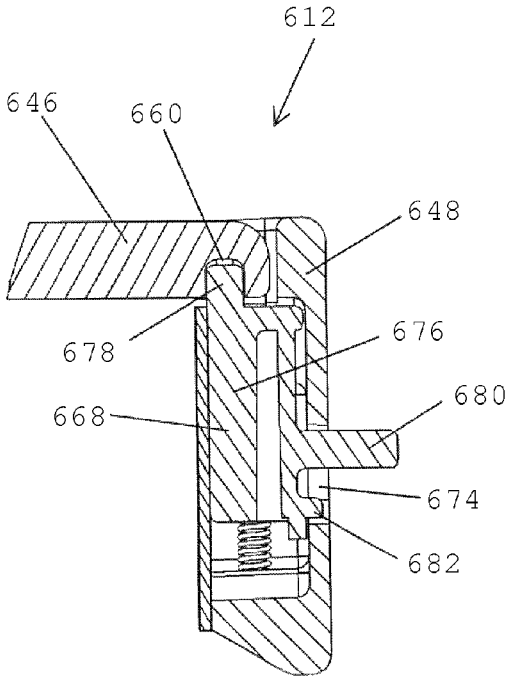
FIG. 6B is a cross-sectional side view of a portion of the latch assembly illustrated in FIG. 6A.

FIG. 6B is a cross-sectional side view of a portion of the latch assembly 612 illustrated in FIG. 6A. In particular, FIG. 6B illustrates a cross-sectional side view of a portion of the transverse member 646 and the pivoting member 648, with the second front tab 682 being shown in greater detail.

As illustrated, the second front tab 682 extends slightly into the plate aperture 674 near an end or side of the plate aperture 674 opposite the position of the front tab 680 when the activator mechanism 668 is in the engaged position. Prior to moving the activator mechanism 668 from the engaged position to the disengaged position, the activator mechanism 668 must be pushed in slightly, against the force of the second resilient member (not illustrated), so that the second front tab 682 no longer extends slightly into the plate aperture 674. Alternatively, the activator mechanism 668 can be designed without the second resilient member and the second front tab 682 can be allowed to flex slightly inwardly relative to the mechanism body 676, so that the second front tab 682 no longer extends slightly into the plate aperture 674.

Subsequently, when the second front tab 682 has been removed from the plate aperture 674, the activator mechanism 668 can then be moved translationally, as with the previous embodiments, from the engaged position to the disengaged position. Then, with the activator mechanism 668 in the disengaged position, i.e. with the end tab 678 no longer positioned within the recessed area 660 of the transverse member 646, the pivoting member 648 can be pivoted relative to the transverse member 646 from the first position to the second position. Stated another way, with the activator mechanism 668 in the disengaged position, the latch assembly 612 can quickly and easily be moved to the unlocked position.

Figure 7A:
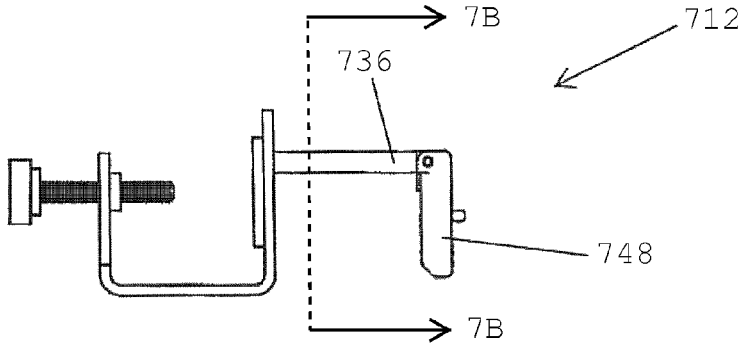
FIG. 7A is a side view of yet another embodiment of the latch assembly.

FIG. 7A is a side view of yet another embodiment of a latch assembly 712 having features of the present invention. As illustrated in FIG. 7A, the latch assembly 712 is substantially similar to the latch assembly 12 illustrated and described above with regard to FIG. 2A. However, in this embodiment, as will be described below, the pivoting member 748 of the locking assembly 736 has a slightly different design than that of the pivoting member 348 illustrated and described above with regard to FIG. 3A.

Figure 7B:
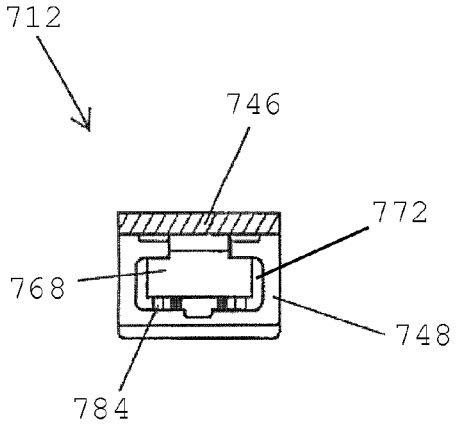
FIG. 7B is a cross-sectional back view of a portion of the latch assembly taken on line 7B-7B in FIG. 7A.

FIG. 7B is a cross-sectional back view of a portion of the latch assembly 712 taken on line 7B-7B in FIG. 7A. In particular, FIG. 7B illustrates a cross-sectional back view of a portion of the transverse member 746 and the pivoting member 748. As illustrated in FIG. 7B, the pivoting member 748 further includes a pair of guide pins 784, or guide rails, that are positioned and oriented so as to guide the translational movement of the activator mechanism 768 when the activator mechanism 768 is moved between the engaged position and the disengaged position. In this embodiment, the guide pins 784 are positioned substantially within the member cavity 772. Additionally, the activator mechanism 768 includes a pair of pin apertures (not illustrated) that enable the activator mechanism 768 to slide and/or be guided along the guide pins 784 as the activator mechanism 768 moves translationally from the engaged position to the disengaged position.

Figure 7C:
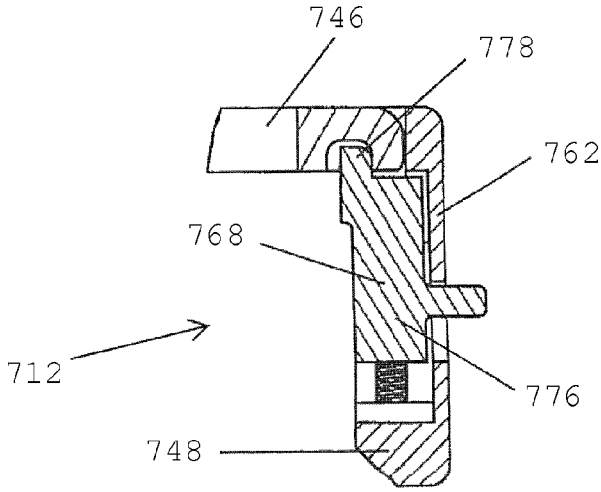
FIG. 7C is a cross-sectional side view of a portion of the latch assembly illustrated in FIG. 7A.

FIG. 7C is a cross-sectional side view of a portion of the latch assembly 712 illustrated in FIG. 7A. In particular, FIG. 7C illustrates a cross-sectional side view of a portion of the transverse member 746 and the pivoting member 748. As illustrated in FIG. 7C, the pivoting member 748 does not include a back plate, and the pivoting member 748 utilizes the guide pins 784 (illustrated in FIG. 7B) to guide translational movement of the activator mechanism 768 rather than having the face plate 762 and a back plate guide translational movement of the activator mechanism, as occurred in the embodiment described above in FIG. 3A.

Further, as illustrated in this embodiment, the mechanism body 776 of the activator mechanism 768 can be somewhat rectangle shaped. Alternatively, the mechanism body 776 can have a different shape.

It should be noted that the specific designs and features of the latch assemblies as illustrated herein can be combined or omitted as desired, and additional features can be added, to allow for greater design flexibility.

Figure 8:
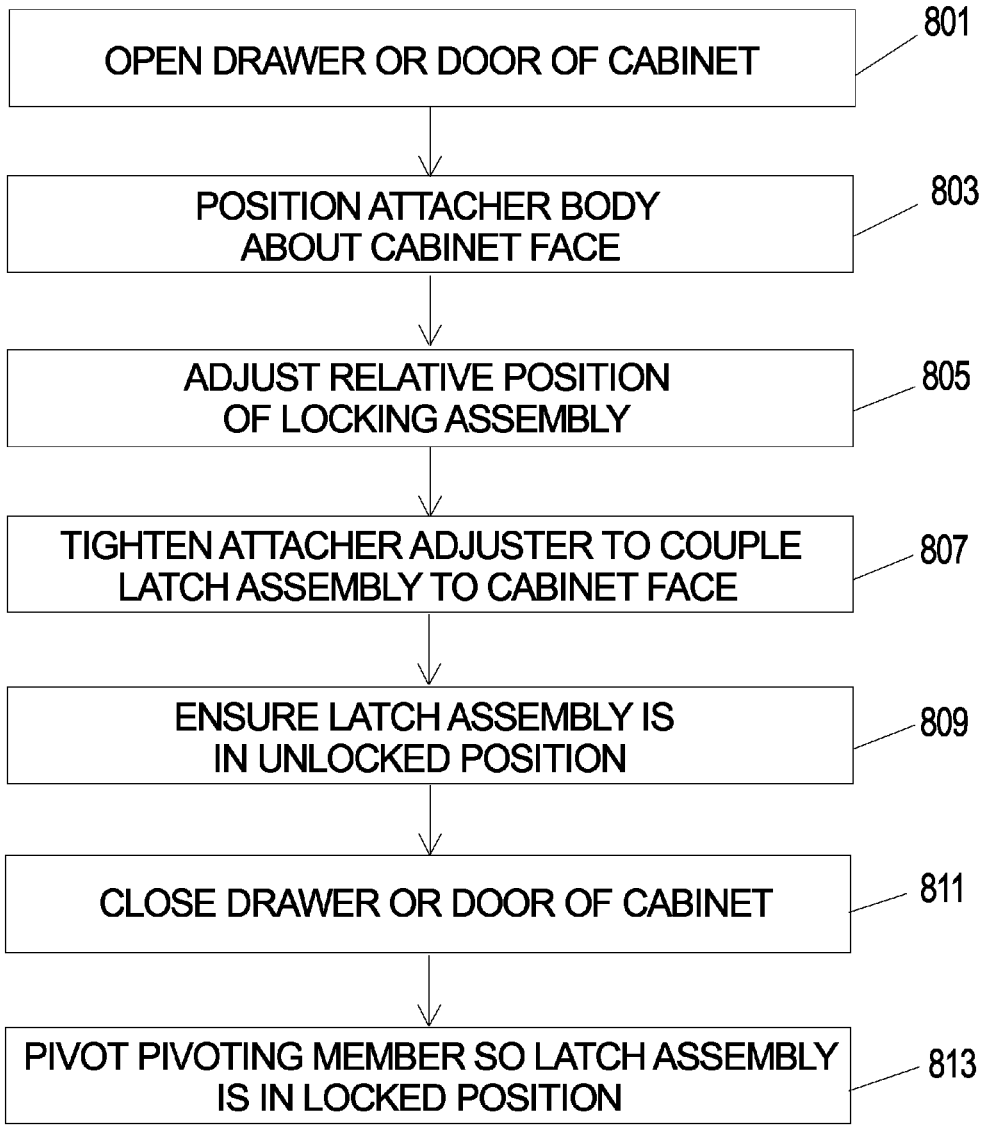
FIG. 8 is a simplified flow chart illustrating the installation and activation of the latch assembly on a cabinet.

FIG. 8 is a simplified flow chart illustrating the installation and activation of the latch assembly on a cabinet. It should be noted that any of the steps described below can be combined or omitted as desired, additional steps can be added, and/or the order of the steps can be changed, without otherwise altering the intended breadth and scope of the present invention.

In step 801, the drawer or door of the cabinet is opened. This provides the necessary access to the portion of the cabinet face that is positioned adjacent to the drawer or door onto which the latch assembly is to be installed. Additionally, adjacent drawers or doors can also be opened, if necessary, to provide better access to the cabinet face.

In step 803, the attacher body of the attachment assembly is positioned about the cabinet face adjacent to the drawer or door onto which the latch assembly is to be installed. Further, in step 805, the position of the locking assembly relative to the attachment assembly can be set or adjusted, as necessary, with the adjustment assembly. In one embodiment, the locking assembly is adjusted so that the transverse member will be positioned as close as reasonably possible to the edge, i.e. the top, bottom or side, of the drawer or door onto which the latch assembly is to be installed.

Additionally, in step 807, the attacher adjuster is tightened so that the latch assembly is effectively coupled to the cabinet face. Further, in step 809, one should ensure that the latch assembly is in the unlocked position, with the pivoting member of the locking assembly being in the second position relative to the transverse member.

Still further, in step 811, the drawer or door onto which the latch assembly is being installed is closed. Then, in step 813, the pivoting member is pivoted relative to the transverse member so that the pivoting member is in the first position, and the latch assembly is in the locked position.

While a number of exemplary aspects and embodiments of a latch assembly 12 have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A latch assembly for use with a cabinet that includes a cabinet body and a moving component, the latch assembly comprising:

a transverse member that is selectively coupled to the cabinet body, the transverse member including a recessed area; and a pivoting member that is pivotally secured to the transverse member, the pivoting member pivoting relative to the transverse member between a first position in which the pivoting member inhibits large scale movement of the moving component relative to the cabinet body, and a second position in which the pivoting member allows for large scale movement of the moving component relative to the cabinet body; wherein, in the second position, the pivoting member is substantially longitudinally aligned with the transverse member; wherein the pivoting member includes an activator mechanism having a first tab that is selectively positioned within the recessed area when the pivoting member is in the first position, the pivoting member being inhibited from pivoting relative to the transverse member when the first tab is positioned within the recessed area, and the pivoting member being allowed to pivot relative to the transverse member between the first position and the second position when the first tab is removed from the recessed area.

2. The latch assembly of claim 1 wherein the activator mechanism further includes a second tab that can be manually manipulated to move the activator mechanism between an engaged position wherein the first tab is positioned within the recessed area, and a disengaged position wherein the first tab is removed from the recessed area.

3. The latch assembly of claim 2 wherein the pivoting member further includes a face plate having a plate aperture, and wherein the second tab extends through the plate aperture.

4. The latch assembly of claim 1 wherein the moving component includes a component face, wherein the pivoting member pivots relative to the transverse member approximately ninety degrees between the first position, wherein the pivoting member is substantially parallel to the component face, and the second position, wherein the pivoting member is substantially perpendicular to the component face.

5. The latch assembly of claim 1 further comprising an attachment assembly that is selectively attached to the cabinet body, wherein the transverse member is adjustably secured to the attachment assembly.

6. The latch assembly of claim 5 wherein the attachment assembly includes an attacher body that is selectively attached to the cabinet body, and a support pad that is positioned substantially between the attacher body and the cabinet body.

7. The latch assembly of claim 5 further comprising an adjustment assembly that adjusts the position of the transverse member relative to the attachment assembly.

8. A latch assembly for use with a cabinet that includes a cabinet body and a moving component, the latch assembly comprising:

a transverse member that is selectively coupled to the cabinet body, the transverse member including a distal end that cantilevers away from the cabinet body; and a pivoting member that is pivotally secured to the distal end of the transverse member, the pivoting member pivoting relative to the distal end of the transverse member between a first position in which the pivoting member inhibits large scale movement of the moving component relative to the cabinet body, and a second position in which the pivoting member allows for large scale movement of the moving component relative to the cabinet body; wherein, in the second position, the pivoting member is substantially longitudinally aligned with the transverse member; wherein a portion of the pivoting member selectively engages a portion of the transverse member when the pivoting member is in the first position to selectively inhibit the pivoting member from pivoting relative to the transverse member and to selectively inhibit large scale movement of the moving component relative to the cabinet body.

9. The latch assembly of claim 8 wherein the pivoting member includes an activator mechanism, and wherein one of the transverse member and the activator mechanism includes a recessed area and the other of the activator mechanism and the transverse member includes a first tab that is selectively positioned within the recessed area, the pivoting member being inhibited from pivoting relative to the transverse member when the first tab is positioned within the recessed area, and the pivoting member being allowed to pivot relative to the transverse member between a first position and a second position when the first tab is removed from the recessed area.

10. The latch assembly of claim 9 wherein the activator mechanism further includes a second tab that can be manually manipulated to move the activator mechanism between an engaged position wherein the first tab is positioned within the recessed area, and a disengaged position wherein the first tab is removed from the recessed area.

11. The latch assembly of claim 9 wherein the moving component includes a component face, wherein the distal end of the transverse member extends from the cabinet body past the moving component when the moving component is closed; wherein the pivoting member pivots relative to the transverse member approximately ninety degrees between the first position, wherein the pivoting member is substantially parallel to the component face, and the second position, wherein the pivoting member is substantially perpendicular to the component face.

12. The latch assembly of claim 8 further comprising an attachment assembly that is selectively attached to the cabinet body, wherein the transverse member is adjustably secured to the attachment assembly.

13. The latch assembly of claim 12 wherein the attachment assembly includes an attacher body that is selectively attached to the cabinet body, and a support pad that is positioned substantially between the attacher body and the cabinet body.

14. The latch assembly of claim 12 further comprising an adjustment assembly that adjusts the position of the transverse member relative to the attachment assembly.

15. A latch assembly for use with a cabinet that includes a cabinet body and a moving component, the moving component having a component face, the latch assembly comprising:

a transverse member that includes a first end and a second end;

an attachment assembly that is selectively attached to the cabinet body, the adjustment assembly securing the first end of the transverse member to the cabinet body with the second end of the transverse member cantilevering away from the cabinet body, the adjustment assembly including an attacher body having pair of adjuster slots and a pair of adjuster attachers that extend through the adjuster slots and thread into the first end of the transverse member, wherein, when the adjuster attachers are loosened, the transverse member is movable relative to the attacher body to adjust the position of the transverse member relative to the moving component, and when the adjuster attachers are tightened, the transverse member is fixed to the attacher body; and a pivoting member that is pivotally coupled to the second end of the transverse member, the pivoting member selectively engaging the component face to selectively inhibit large scale movement of the moving component relative to the cabinet body.

16. The latch assembly of claim 15 wherein the attachment assembly includes a support pad that is positioned substantially between the attacher body and the cabinet body.

17. The latch assembly of claim 15 wherein the pivoting member pivots relative to the transverse member between a first position in which the pivoting member inhibits large scale movement of the moving component relative to the cabinet body, and a second position in which the pivoting member allows for large scale movement of the moving component relative to the cabinet body.

18. The latch assembly of claim 17 wherein a portion of the pivoting member selectively engages a portion of the transverse member to selectively inhibit the pivoting member from pivoting relative to the transverse member and to selectively inhibit large scale movement of the moving component relative to the cabinet body.

19. The latch assembly of claim 17 wherein the pivoting member includes an activator mechanism, and wherein one of the transverse member and the activator mechanism includes a recessed area and the other of the activator mechanism and the transverse member includes a first tab that is selectively positioned within the recessed area, the pivoting member being inhibited from pivoting relative to the transverse member when the first tab is positioned within the recessed area, and the pivoting member being allowed to pivot relative to the transverse member between the first position and the second position when the first tab is removed from the recessed area.

20. The latch assembly of claim 19 wherein the activator mechanism further includes a second tab that can be manually manipulated to move the activator mechanism between an engaged position wherein the first tab is positioned within the recessed area, and a disengaged position wherein the first tab is removed from the recessed area.

21. The latch assembly of claim 15 wherein the moving component includes a component face, wherein the pivoting member pivots relative to the transverse member approximately ninety degrees between a first position, wherein the pivoting member is substantially parallel to the component face, and a second position, wherein the pivoting member is substantially perpendicular to the component face and the pivoting member is substantially longitudinally aligned with the transverse member.

22. The latch assembly of claim 15 wherein the transverse member includes a recessed area near the second end; wherein the pivoting member pivots relative to the transverse member between a first position in which the pivoting member inhibits large scale movement of the moving component relative to the cabinet body, and a second position in which the pivoting member allows for large scale movement of the moving component relative to the cabinet body; wherein, in the second position, the pivoting member is substantially longitudinally aligned with the transverse member; wherein the pivoting member includes an activator mechanism having a first tab that is selectively positioned within the recessed area when the pivoting member is in the first position, the pivoting member being inhibited from pivoting relative to the transverse member when the first tab is positioned within the recessed area, and the pivoting member being allowed to pivot relative to the transverse member between the first position and the second position when the first tab is removed from the recessed area.

* * * * *